United States Patent [19]

Asano et al.

[11] 4,310,255

[45] Jan. 12, 1982

[54] PRINTER WITH CARTRIDGE TYPE WHEEL

[75] Inventors: Kiyomitsu Asano, Musashino; Tetsuo Watanabe, Tokyo, both of Japan

[73] Assignees: Ricoh Co., Ltd.; Nihon Tsushin Gijyutsu Kabushiki Kaisha, both of Japan

[21] Appl. No.: 76,389

[22] Filed: Sep. 17, 1979

[30] Foreign Application Priority Data

Sep. 18, 1978 [JP] Japan ..... 53/113585

[51] Int. Cl.[3] ..... B41J 1/30

[52] U.S. Cl. ..... 400/171; 400/144.2; 400/175; 400/208

[58] Field of Search ..... 400/171, 174, 175, 144.2, 400/144.3, 208

[56] References Cited

U.S. PATENT DOCUMENTS

| | | | |
|---|---|---|---|
| 3,878,929 | 4/1975 | Orlens et al. | 400/175 |
| 3,892,303 | 7/1975 | Willcox | 400/172 |
| 3,991,873 | 11/1976 | Paulson et al. | 400/175 |
| 4,026,403 | 5/1977 | Inose et al. | 400/171 |
| 4,071,131 | 1/1978 | Turek et al. | 400/131 |
| 4,127,335 | 11/1978 | Bogert et al. | 400/144.2 |

FOREIGN PATENT DOCUMENTS

| | | | |
|---|---|---|---|
| 132477 | 10/1978 | German Democratic Rep. | 400/144.2 |

OTHER PUBLICATIONS

Cox et al., "Semiautomatic Print Wheel Loader", IBM Technical Disclosure Bulletin, vol. 18, No. 10, p. 3356, 3/76.

McCray, "Print Disc Attachment" IBM Technical Disclosure Bulletin, vol. 18, No. 9, pp. 2988–2989, 2/76.

Okcnogln et al., "Automated Print Wheel . . . " IBM Technical Disclosure Bulletin, vol. 22, No. 4, pp. 1358–1359, 9/79.

Roberti et al., "Impact Printer . . . " IBM Technical Disclosure Bulletin, vol. 22, No. 1, pp. 1–3, 6/79.

*Primary Examiner*—William Pieprz

*Attorney, Agent, or Firm*—McGlew and Tuttle

[57] ABSTRACT

A printer having a mechanism for easy loading of a type wheel rotatably supported by a type wheel cartridge. The type wheel cartridge can be inserted into or withdrawn from a cartridge holder by moving the type wheel cartridge in a direction perpendicular to the axis of the type wheel supported by the type wheel cartridge. Coupling of a shaft of a type selection motor to the type wheel within the type wheel cartridge can be effected by relatively moving the cartridge holder and the type selection motor axially of the type wheel.

22 Claims, 15 Drawing Figures

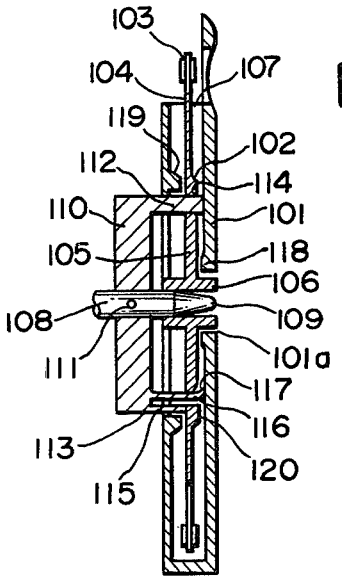
FIG.8
FIG.9
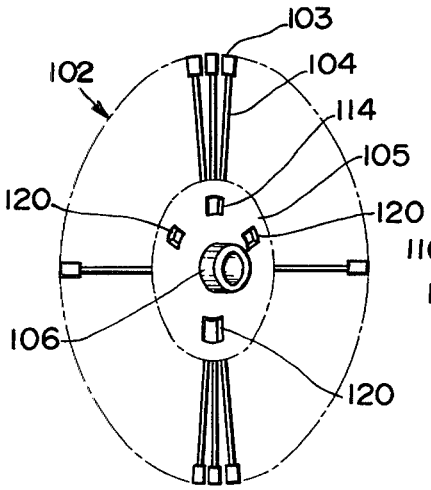
FIG.10
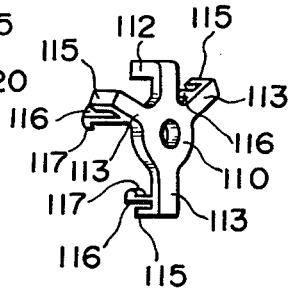

PRINTER WITH CARTRIDGE TYPE WHEEL

BACKGROUND OF THE INVENTION

In a so-called impact printer of the type using a petal-like type wheel, various proposals have been made to effect easy loading of the type wheel when the type wheel is mounted on a type wheel support shaft, so that the handling of the type wheel can be facilitated and loading thereof can be done without the hands and clothes of the operator being soiled, even if the operator is not skilled in the type wheel handling and loading operation. The limits placed on the space available for holding type wheel within a printer, however, have made type wheel loading mechanisms of the prior art not wholly satisfactory in enabling the type wheel to be loaded without any trouble. When emphasis is placed on easy handling of the type wheel, there has arisen the problem that the space within the printer for loading and unloading the type wheel is inevitably increased, thereby increasing the size of the printer.

SUMMARY OF THE INVENTION

An object of the present invention is to provide a printer which enables a type wheel to be loaded and unloaded with ease in spite of the fact that the space within the printer for effecting loading and unloading of the wheel is minimized.

According to the invention, the aforesaid object is accomplished by providing a printer comprising a type wheel cartridge rotatably supporting a type wheel therein, a cartridge holder for detachably holding the cartridge type wheel so that preferably the cartridge type wheel can be inserted into and withdrawn from the cartridge holder by moving the cartridge type wheel in a direction perpendicular to the axis of the cartridge holder, a type selection motor capable of moving relative to the cartridge holder axially of the cartridge type wheel, and means for moving the cartridge holder and/or the type selection motor between an operative position and a standby position, the type selection motor having a shaft capable of being directly or indirectly coupled to the cartridge type wheel.

Another object is to facilitate coupling of the shaft of the type selection motor to the cartridge type wheel and to enable coupling to be effected automatically.

According to the invention, the aforesaid object is accomplished by providing the printer with a mechanism comprising a common lever connecting the cartridge holder holding the cartridge type wheel to the type selection motor, and a motor for driving the common lever, the position in which the common lever is pivotally supported with respect to the cartridge holder and the type selection motor being selected such that the pivotal movement of the common lever moves them relative to each other.

Still another object is to provide a printer wherein the type wheel within the type wheel cartridge can be smoothly coupled to the shaft of the type selection motor in such a manner that they are coupled to each other in a predetermined position with regard to the direction of rotation of the type wheel at all times.

According to the invention, the aforesaid object is accomplished by providing the printer with a connecting arm unit secured to the shaft of the type selection motor and comprising at least one connecting member engageable with the type wheel, and a plurality of holding arms one of which can serve as a connecting member when necessary, the holding arms being constructed such that they engage in apertures formed in the type wheel for holding the latter on opposite sides thereof.

A further object is to provide a printer wherein the type wheel within the cartridge can be maintained in a predetermined home position at all times when the cartridge type wheel is stored elsewhere.

According to the invention, the aforesaid object is accomplished by providing the cartridge with a holding claw supported at the forward end of an arm resiliently attached to the type wheel cartridge and capable of entering a connecting opening formed in the type wheel within the cartridge.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

Figure 11:
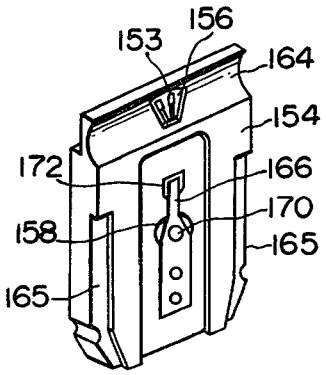
Figure 14:
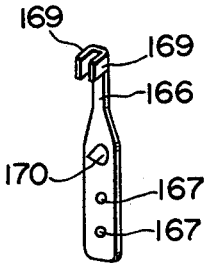
Figure 12:
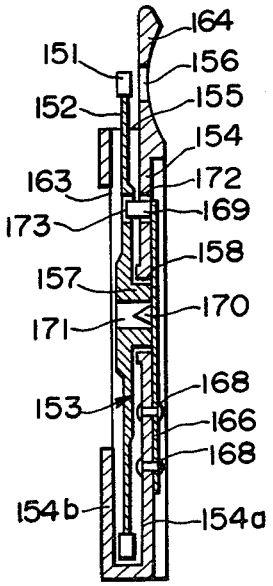
Figure 13:
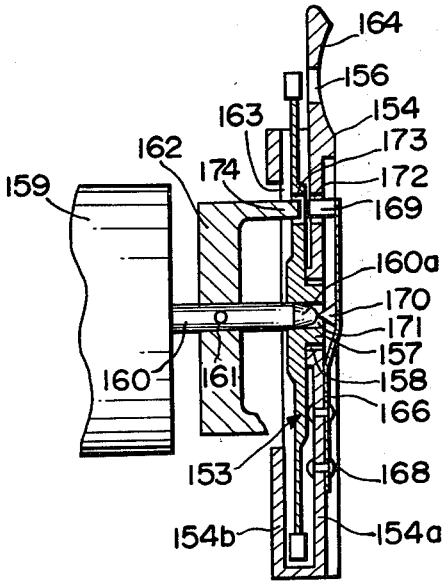

FIG. *7a* is a time chart for a cartridge loading operation;

FIG. *7b* is a chart similar to FIG. *7a* showing the unloading of the cartride to a standby position;

FIG. 8 is a sectional view of a modification of the cartridge type wheel;

FIG. 9 is a perspective view of the cartridge type wheel shown in FIG. 8;

FIG. 10 is a perspective view of the connecting arm unit;

FIG. 11 is a perspective view of another modification of the cartridge type wheel;

FIG. 12 is a vertical sectional view of the cartridge type wheel shown in FIG. 11;

FIG. 13 is a vertical sectional view of the cartridge type wheel coupled to the shaft of the type selection motor; and FIG. 14 is a perspective view of the spring for holding the type wheel within the type wheel cartridge in its home position.

DESCRIPTION OF THE PREFERRED EMBODIMENTS

Embodiments of the invention will now be described with reference to the accompanying drawings.

Figure 1:
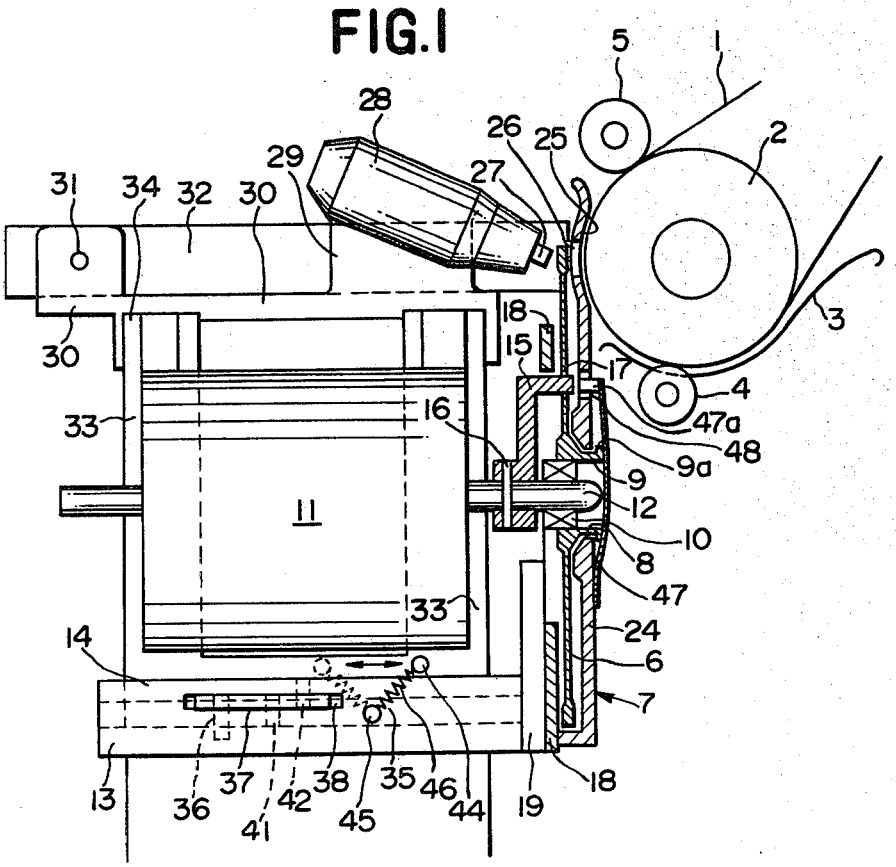
FIG. 1 is a fragmentary sectional side view of the printer comprising one embodiment of the present invention.
Figure 2:
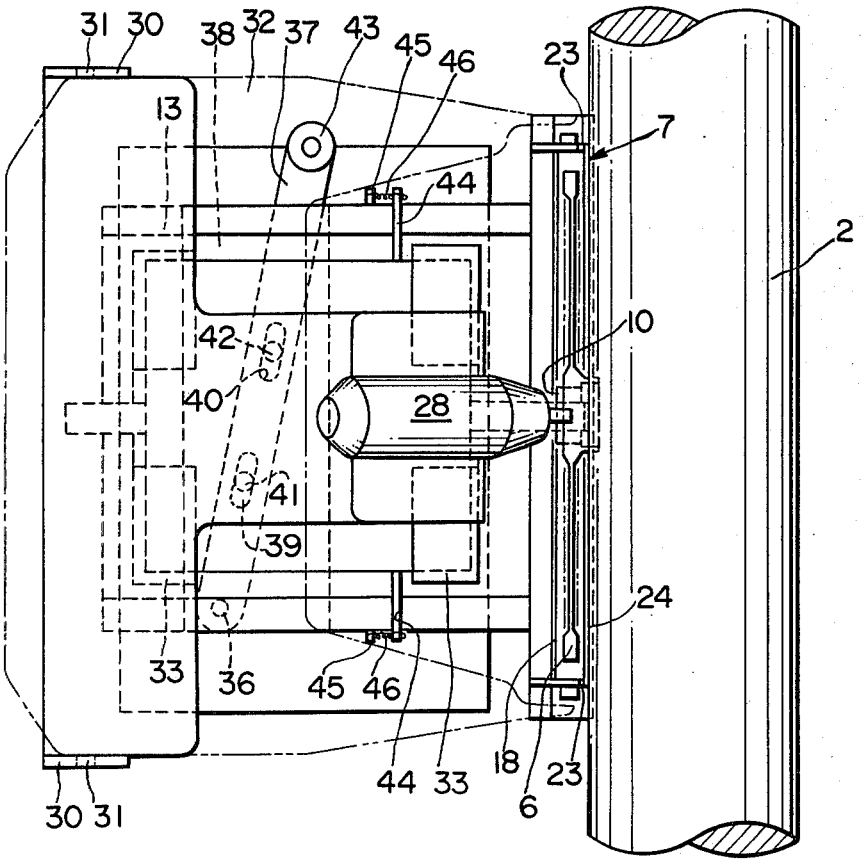
FIG. 2 is a plan view of the printer shown in FIG. 1.
Figure 3:
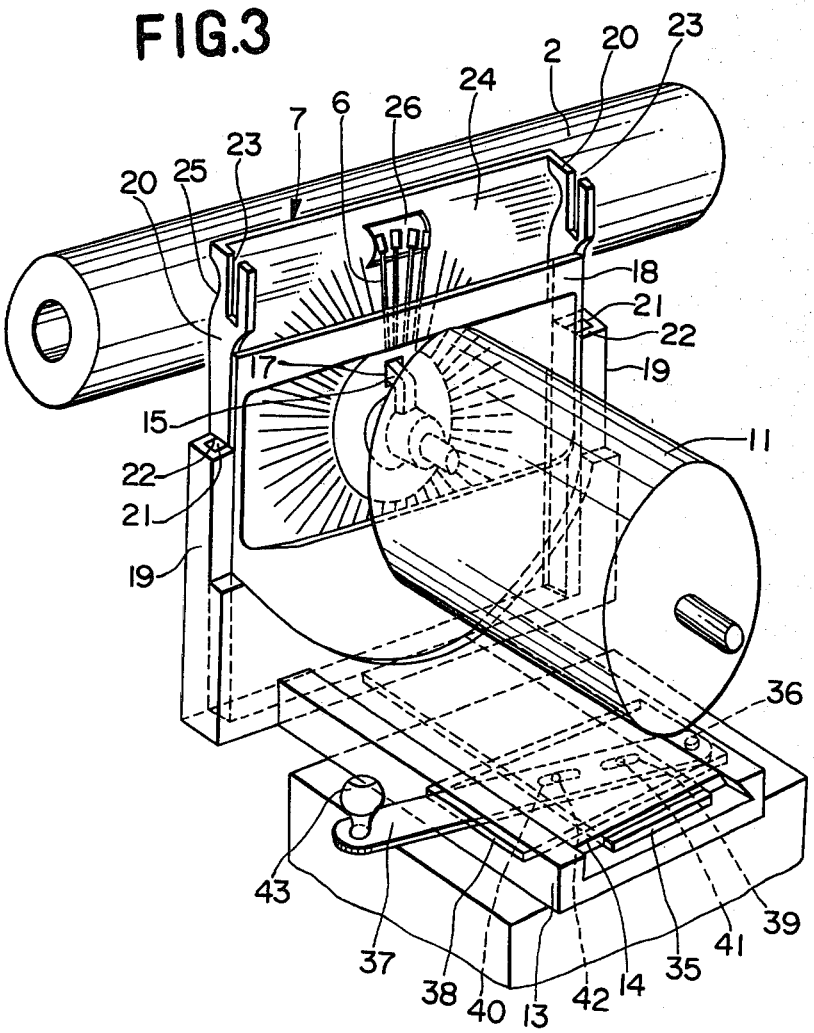
FIG. 3 is a perspective view of the printer shown in FIGS. 1 and 2.
Figure 4:
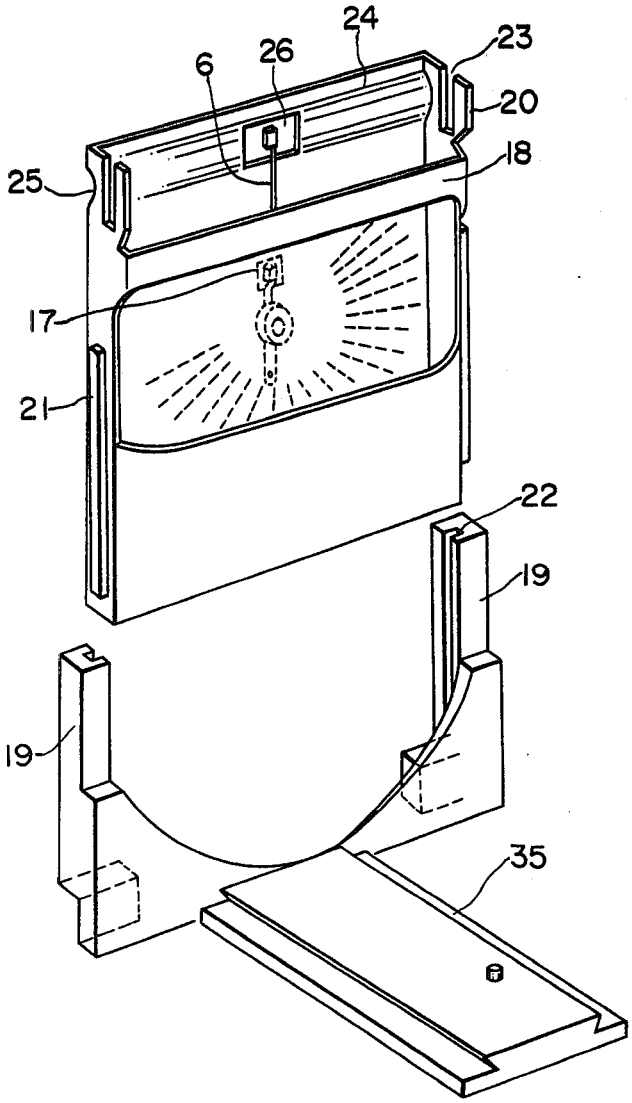
FIG. 4 is a perspective view of the cartridge holder showing the cartridge withdrawn from the cartridge holder.

In FIGS. 1 to 3, a sheet 1 is supplied along a guide 3 to a platen 2 of a printer and forced against the platen 2 by a pinch roller 4. Rotation of the platen 2 moves and sets the sheet 1 at a desired printing position. At this time, a sheet hold-down member 5 forces a portion of the sheet 1 disposed above the printing position against the platen.

A petal-like type wheel 6 carrying type is rotatably supported by a type wheel cartridge 7. More specifically, a plurality of projections 9 formed on the type wheel and located circularly thereon in a manner to project axially of the type wheel 6 are each received, with play, in one of support openings 8 formed in the type wheel cartridge 7, so that the type wheel 6 can move idly within the scope of the play. Each projection 9 is formed at its forward end portion with a bulge 9*a* having a diameter slightly larger than the diameter of each support opening 8. Thus in inserting each projection 9 in the respective support opening 8, the former must be force fitted in the latter. After insertion, the presence of the bulge 9*a* in each projection 9 prevents the dislodging of type wheel 6 from the support opening 8.

Mounted in a center opening of the type wheel 6 is a bearing 10 for supporting a shaft 12 of a type selection motor 11. When the shaft 12 is inserted in the bearing 10, the type wheel 6 is rotatably coupled to the shaft 12 of the type selection motor 11, as a type wheel home position holding spring 47 is merely pushed. At this time, the projection 9 of the type wheel 6 are in floating engagement in the openings 8 formed in the type wheel cartridge 7.

The type selection motor 11 is supported by a carriage base 13 for movement between a position in which the shaft 12 is inserted in the bearing 10 of the type wheel 6 and a position in which the shaft 12 is released from the bearing 10. More specifically, the type selection motor 11 is securedly supported by a motor slide base 14 which in turn is fitted in a dovetail groove formed in the carriage base 13 for sliding movement along the dovetail groove. The carriage base 13 may be mounted on a carriage for movement parallel to the axis of the platen 2.

An L-shaped connecting arm 15 is secured by a pin 16 to the shaft 12 of the type selection motor 11. The pin 16 may be replaced by any other securing member. When the type selection motor 11 is moved in the direction in which the shaft 12 is inserted in the bearing 10, the forward end of the connecting arm 15 is fitted in a connecting opening 17 formed in the type wheel 6, to transmit the rotation of the shaft 12 to the type wheel 6 via the connecting arm 15.

The type wheel cartridge 7 supporting the type wheel 6 is in the form of a box and has a rear lid 18 to close the interior of the cartridge 7 where necessary.

A guide rail 21 is formed on the outer surface of each of side plates 20 of the type wheel cartridge 7. The cartridge 7 can be placed in a cartridge holder 19 by inserting the guide rails 21 from above into guide grooves 22 respectively formed in the cartridge holder 19. Conversely, the cartridge 7 can be removed from the cartridge holder 19 by withdrawing the guide rails 21 from the guide grooves 22 respectively.

The side plates 20 of the cartridge 7 are each formed at upper ends thereof with a ribbon guide 23 for guiding an ink ribbon of the printer. The cartridge 7 has a front plate 24 facing the platen 2 and formed with a recess 25 so that the front plate 24 is in spaced juxtaposed relation to the platen 2 with the space being large enough not to interfere with the movement of the sheet 1 therethrough. The recess 25 is formed with a window 26 for permitting each type to extend therethrough to print a symbol on the sheet 1.

A printing magnet 28 provided with a printing hammer 27 for impacting each type of the type wheel 6 against the sheet 1 is secured to a printing hammer holder 29 which in turn is secured to a ribbon cartridge holder 30. Alternatively, the printing hammer holder 29 may be formed integrally with the ribbon cartridge holder 30.

A ribbon cartridge 32 is detachably mounted on and held by the ribbon cartridge holder 30 by means of a pin 31. The ribbon cartridge 32 having a ribbon drive is mounted on the ribbon cartridge holder 30 in such a manner that the ribbon is guided by a ribbon guide 23 (FIG. 3) of the cartridge 7. When the ribbon cartridge 32 is mounted as aforesaid, the ribbon extends past the window 26 and between the type wheel 6 and the front plate 24.

The ribbon cartridge holder 30 is secured to an upper bracket 34 of a motor holder 33 securedly holding the type selection motor 11 secured to the motor slide base 14. As the motor slide base 14 moves, the ribbon cartridge holder 30 moves together with the motor holder 33 in reciprocatory movement toward and away from the platen 2.

Inserted in a groove formed on the motor slide base 14 is a type wheel cartridge slide base 35 which is guided by the groove on the motor slide base 14 for sliding movement on the carriage base 13. The cartridge holder 19 is attached to one end portion of the type wheel cartridge slide base 35. Alternatively, the cartridge holder 19 may be formed integrally therewith. Since the type wheel cartridge 7 is mounted in the cartridge holder 19, the type wheel cartridge 7 moves together with the type wheel cartridge slide base 35 in reciprocatory movement toward and away from the platen 2.

A loading and unloading lever 37 pivotally connected to the carriage base 13 by a pin 36 is inserted in an opening 38 formed in a portion of the motor slide base 14 and the type wheel cartridge slide base 35 in contact with each other. The opening 38 extends between two sides of the carriage base 13.

The loading and unloading lever 37 is formed with slots 39 and 40. A stud 41 on the type wheel cartridge slide base 35 is received in the slot 39, and a stud 42 on the motor slide base 14 is received in the slot 40. The loading and unloading lever 37 has attached thereto a knob 43 which may be turned by the operator to pivotally move the lever 37 about the pin 36 to thereby move the motor 11, ribbon cartridge 32 and type wheel cartridge 7 between a replacing or standby position remote from the platen 2 and an operative position near the platen 2. The type wheel home position holding spring 47 is secured to the front plate 24. The spring 47 has at its forward end an operating portion 47*a* which is formed for introduction into an opening 48 formed in the front plate 24. The forward operating portion 47*a* of the spring 47 is juxtaposed against the portion of the connecting arm 15 which is fitted in the connecting opening 17. When the connecting arm 15 is fitted in the connecting opening 17, the spring 47 is flexed toward the platen 2. In unloading the type wheel cartridge 7, the forward operating portion 47*a* of the spring 47 is resiliently introduced into the connecting opening 17 of the type wheel 6 to hold the petal-like type wheel 6 in its home position. Thus when the motor 11 is coupled again to the type wheel 6, aligning of the home position of the shaft 12 of the motor 11 with the home position of the type wheel 6 is facilitated. The movement of the connecting arm 15 is synchronized to the movement of the forward operating position 47*a* of the spring 47 by the action of the shaft 12 and the spring 47.

The motor slide base 14 is under the influence of the biasing force of a spring to maintain the motor 11, ribbon cartridge 32 and type wheel cartridge 7 in the standby position and the operative position so long as no force is exerted thereon to move them. More specifically, a compression toggle spring 46 is mounted between a stud 44 secured to the motor slide base 14 and a stud 45 secured to the carriage base 13.

The operation of the embodiment shown and described hereinabove will now be described. When it is desired to replace the old type wheel by a new type wheel after a printing operation is performed, the loading and unloading lever 37 is moved counterclockwise in FIG. 2 about the pin 36. Pivotal movement of the loading and unloading lever 37 moves the studs 41 and 42 leftwardly in FIG. 2, to thereby move the type wheel cartridge slide base 35 and the motor slide base 14 in the same direction. The distance covered by the movement of the stud 41 is smaller than the distance covered by the movement of the stud 42. That is, the distance covered by the movement of the type wheel cartridge holder 19 secured to the type wheel cartridge slider 35 is smaller than the distance covered by the movement of the motor 11 and printing magnet 28 secured to the motor slide base 14. The distance covered by the movement of the type wheel cartridge holder 19 is set such that it is moved away from the platen by a space large enough to permit the type wheel cartridge 7 to be readily inserted into or withdrawn from the type wheel cartridge holder 19. At this time, the distance covered by the movement of the motor 11 is selected such that its shaft 12 is substantially disconnected from the type wheel cartridge 7, and the petal-like type wheel 6 is held in its home position with the cartridge 7.

The motor 11 and type wheel cartridge holder 19 are moved to the standby position where they are kept stationary by the action of the toggle spring 46.

In the standby position, the ribbon within the ribbon cartridge 32 is removed from the ribbon guides 23 and the type wheel cartridge 7 is withdrawn upwardly from the type wheel cartridge holder 19. After a new type wheel cartridge 7 is mounted in the type wheel cartridge holder 19, the loading and unloading lever 37 is moved clockwise in pivotal movement about the pin 36 in FIG. 2, thereby moving the type wheel cartridge 7 and the type selection motor 11 to the operative position in which they are held by the action of the toggle spring 46.

The type wheel cartridge 7 has the function of the case for containing the type wheel 6 safely therein and the functions of holding down the sheet and guiding the ribbon in the printing position. The use of the type wheel cartridge 7 enables the construction of the type wheel 6 to be simplified. The type wheel cartridge 7 can contain one of various kinds of type wheels carrying type of different fonts known in the art.

In the embodiment shown and described hereinabove, positioning of the motor 11 and the ribbon cartridge 32 and positioning of the type wheel 6 can be effected by means of a single loading and unloading lever 37 by utilizing the relative movements of the motor 11 and the type wheel cartridge holder 19. Thus the operation is simple, the mechanism requires a small number of parts, and the space in the printer can be minimized because the space required for loading and unloading operation has only to be large enough to allow withdrawal of the type wheel cartridge 7 from the type wheel cartridge holder 19. Thus the printer has its construction simplified and its reliability and safety in performance are increased while its production cost is reduced.

Figure 5:
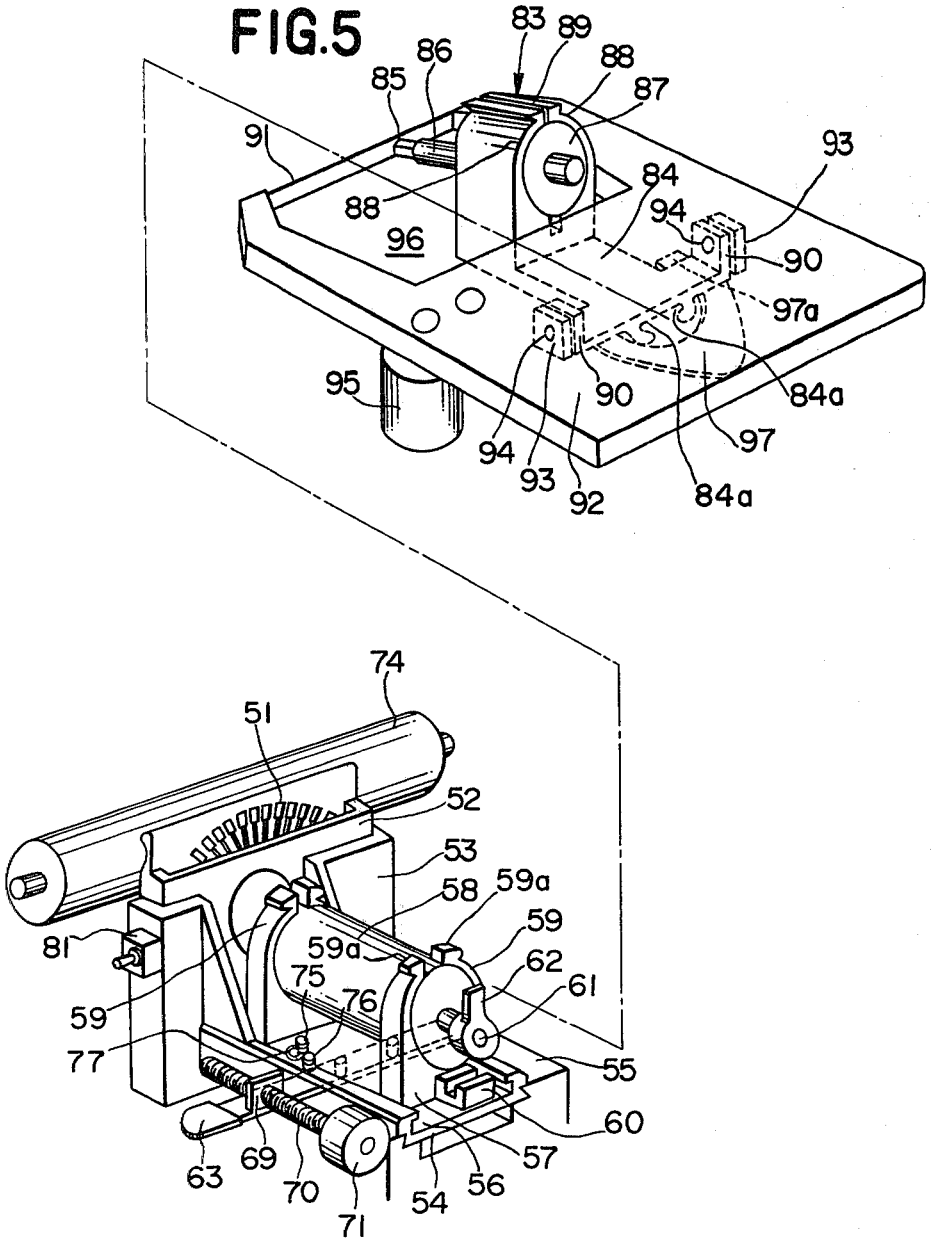
FIG. 5 is a perspective view of the printer comprising another embodiment of the invention, showing its essential portions with the ribbon cartridge being withdrawn therefrom.
Figure 6:
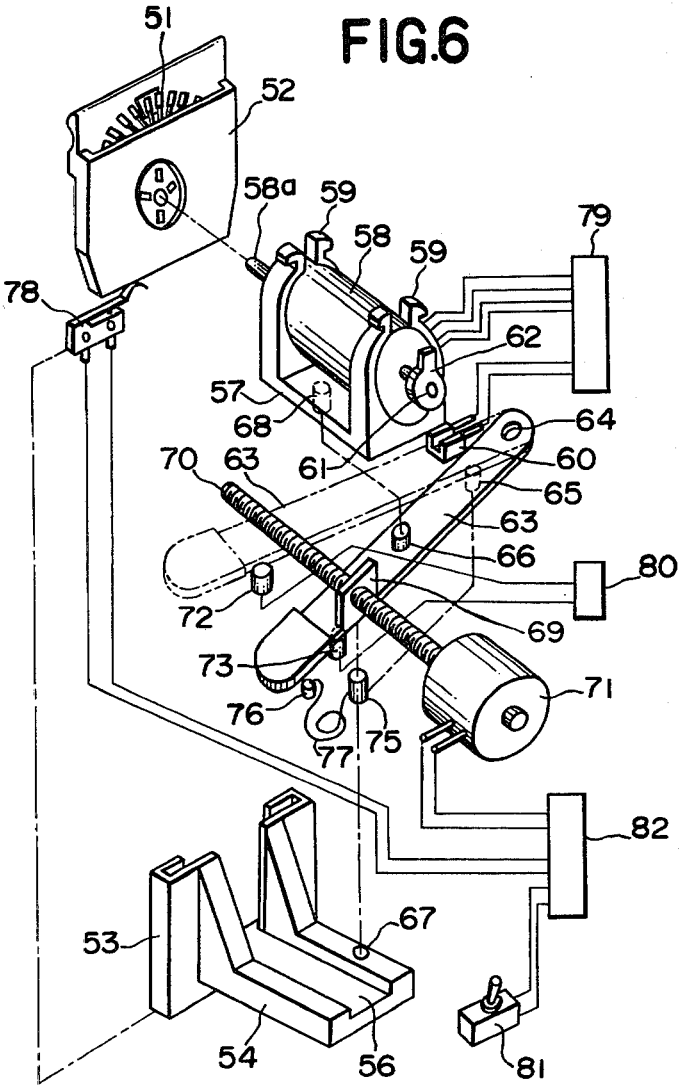
FIG. 6 is an exploded perspective view of the printer shown in FIG. 5, showing its essential portions with the printing hammer unit being removed therefrom.

In FIGS. 5 and 6, there is shown another embodiment of the invention wherein a type wheel cartridge 52 rotatably supporting a petal-like type wheel 51 is removably held by a type wheel cartridge holder 53.

A wheel cartridge holder base 54 having the wheel cartridge holder 53 secured thereto is slidably supported by a carriage 55.

Formed on the type wheel cartridge holder base 54 is a groove 56 supporting thereon for sliding movement a motor base 57 having secured thereto motor holders 59 for securedly holding a type selection motor 58 on the motor base 57. The motor holders 59 clampingly hold the motor 58 on the motor base 57.

The motor base 57 has mounted thereon a type wheel home position detecting element 60, and the motor 58 has a shaft 61 mounting thereon a home position detecting arm 62 for detecting the type wheel 51 loaded in the home position.

A lever 63 is formed at one end portion thereof with an opening 64 receiving therein a pin secured to the carriage 55 to enable the lever 63 to move in pivotal movement about the opening 64. The lever 63 has attached thereto a first engaging pin 65 received in an engaging opening 67 formed in the cartridge holder base 54, and a second engaging pin 66 received in an opening 68 formed in the motor base 57. Mounted on the lever 63 in a position near its free end is a nut 69 which is in threadable engagement with a threaded shaft 70.

The threaded shaft 70 is connected to a motor 71 mounted on the carriage 55 and driven thereby for rotation in the normal and reverse directions. In place of the threaded shaft 70 and the motor 71, a hydraulic cylinder and a solenoid may be used.

Rotation of the threaded shaft 70 in the normal and reverse direction moves the nut 69 in reciprocatory movement, to thereby move the cartridge holder base 54 and the motor 58 between an operative position and a standby position. The carriage 55 mounts thereon a detection element 72 for detecting the lever 63 in an operative position and a detection element 73 for detecting the lever 63 in a standby position. Movement of the lever 63 to the operative position moves the type wheel cartridge holder 52 and the motor 58 to the operative position, and movement of the lever 63 to the standby position moves the type wheel cartridge holder 52 to the standby position in which it is spaced apart from the platen 74 of the printer and the motor 58 to the standby position in which it is spaced apart from the type wheel 51.

Mounted between a pin 75 attached to the motor base 57 and a pin 76 attached to the cartridge holder base 54 is a toggle spring 77 which performs the function of holding the motor 58 in the operative position or the standby position. The toggle spring 77 can be made to engage the carriage 55 and the lever 63.

The cartridge holder 53 is provided with a cartridge detection element 78, such as a microswitch, for ascertaining the loading of the type wheel cartridge 52 in a predetermined position.

The motor 58 and the element 60 for detecting the type wheel 51 in the home position are connected to a terminal 79, and the element 72 for detecting the cartridge wheel 51 in the operative position and the element 73 for detecting the cartridge wheel 51 in the standby position are connected to a terminal 80. The motor 71 for moving the lever 63, a cartridge detection element 78 and a switch 81 for giving standby instructions are connected to a terminal 82. The terminals 79,80 and 82 may be connected together by a single connector.

A printing hammer unit 83 is provided for carrying out printing of symbols by striking selected types of the type wheel 51 against the sheet wound on the platen 74. The printing hammer unit 83 includes a frame 84 mounted on the motor holders 59 supporting the type selection motor 58. By inserting engaging members 59*a* formed at the upper end of the motor holders 59 in a groove 84*a* formed on the frame 84, the motor holders 59 can be tightened to clampingly hold the motor 58 and the frame 84 can be supported on the motor holders 59.

Mounted on the frame 84 is a hammer frame 87 having a guide 86 for slidably supporting a printing hammer 85. The hammer frame 87 is held in position by a clamp 89 through a holder 88 secured to the frame 84.

The frame 84 has connected thereto blocks 90 having pivotally connected through pins 94 to legs 93 of a ribbon cartridge 92 for containing therein an ink ribbon 91. The ribbon cartridge 92 can be connected to a ribbon drive motor 95.

The holder 88, hammer frame 87, guide 86 and printing hammer 85 of the printing hammer unit 83 project upwardly from below the ribbon cartridge 92 in a space 96 provided in the ribbon cartridge 92. The ribbon cartridge 92 is urged by the biasing force of a setting spring 97 when moved to the operative position, to cause the ribbon 91 to be positioned between the type to be struck by the printing hammer 85 and the platen 74. The setting spring 97 can be readily mounted and removed if its end portions 97*a* are formed in such a way as to clamp a portion of the legs 94. The setting spring 97 mounted on the legs pushes and moves upwardly an end portion of the ribbon cartridge 9 opposite to the type wheel cartridge 52 to avoid wobbling of the ribbon cartridge 92 which might cause the ribbon to be displaced from its normal position.

The operation of the embodiment shown in FIGS. 5 and 6 will now be described. Before operation, the ribbon cartridge 92 is mounted on the printing hammer unit 83.

Prior to starting of printing, the type wheel cartridge 52 supporting the desired type wheel 51 is inserted in the cartridge holder 53. At this time, the motor 58 has its output shaft 58*a* kept stationary in its home position by the action of the home position detecting arm 62 and home position detecting element 60. Meanwhile the type wheel 51 is held in the home position within the cartridge 52.

Figure 7A:
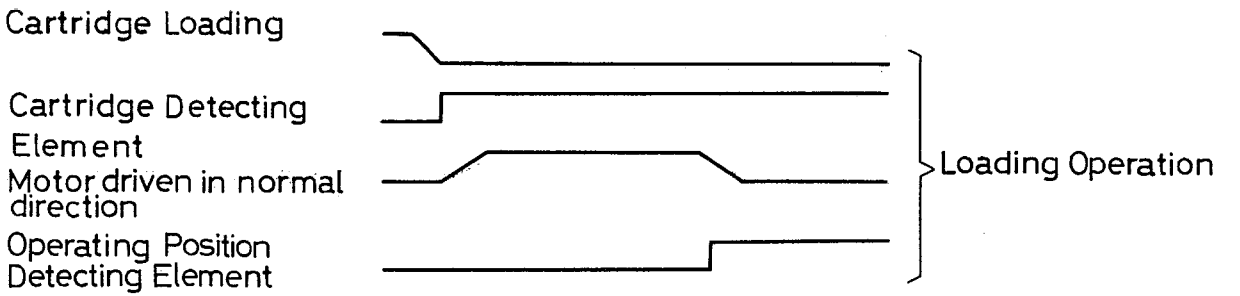

Upon the type wheel cartridge 52 being inserted in a predetermined position in the cartridge holder 53, the cartridge detecting element 78 is actuated to drive the motor 71 for rotation in a direction for coupling the output shaft 58*a* of the motor 58 to the type wheel 51. More specifically, rotation of the motor 71 rotates the threaded shaft 70 to move the nut 69 toward the type wheel cartridge 52. Movement of the nut 69 moves the lever 63 in pivotal movement, and pivotal movement of the lever 63 causes the first engaging pin 65 and the second engaging pin 66 to forwardly move the cartridge holder base 54 and the motor base 57 respectively toward the platen 74. Since the distance covered by the movement of the motor base 57 is greater than the distance covered by the movement of the cartridge holder base 54, the shaft 58*a* of the motor 58 is coupled to the cartridge 52 in the operative position, and the cartridge holder 53 is also set in a predetermined position. Detection of the coupling of the motor 58 to the type wheel 51 in the operative position by the operative position detecting element 72 stops the rotation of the motor 71. While the type wheel cartridge 52 is being connected to the motor 58 in the operative position, the lever 63 is maintained in the operative position by the action of the toggle spring 77 irrespective of the backlash of the nut 69 and the threaded shaft 70, thereby holding the type wheel cartridge 52 and the motor 58 positively in the operative position. Movements of various parts occurring when the type wheel cartridge 52 is connected to the motor 58 in the operative position are shown in a time chart in FIG. 7*a*.

Figure 7B:
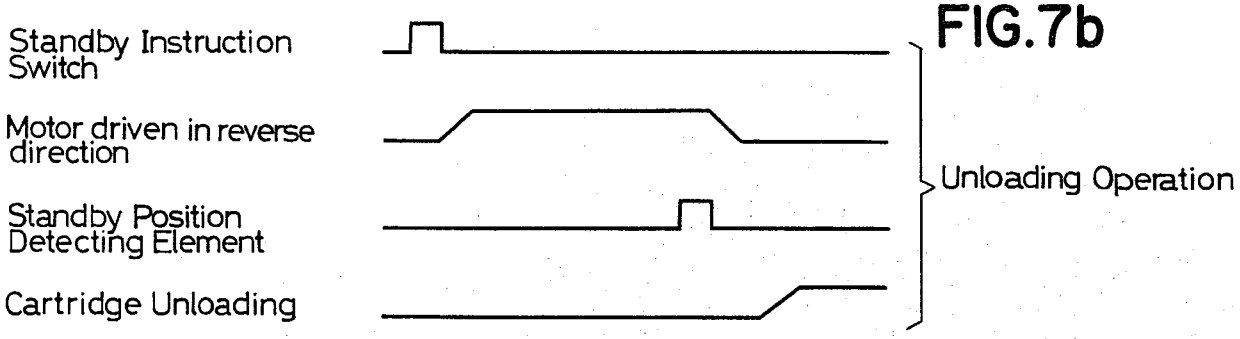

When it is desired to unload the type wheel cartridge 52 for replacements or inspection of the type wheel 51, the cartridge 52 is moved to the standby position. To this end, the switch 81 for giving standby instructions is actuated. When the switch 81 is actuated, the motor 71 is rotated in the reverse direction to rotate the threaded shaft 71 in the reverse direction to thereby move the nut 69 rearwardly. Rearward movement of the nut 69 moves the lever 63 in pivotal movement in a direction opposite to the direction of its movement for moving the motor 58 to the operative position, so that the motor 58 and cartridge 52 move in the reverse directions. The motor 71 stops rotating as soon as the standby position detecting element 73 detects the arrival of the lever 63 at the standby position. The cartridge holder 53 is located away from the platen 74 in the operative position, thereby facilitating unloading of the cartridge 52 from the cartridge holder 53. Unloading of the cartridge 52 de-actuates the cartridge detecting element 78. Movements of various parts occurring when the cartridge 52 is unloaded and the associated parts move to the standby position are shown in a time chart in FIG. 7*b*.

In the embodiment shown and described hereinabove, the sliding movement of the type selection motor 58 and the movement of the cartridge holder 53 have been described as occurring as interlocked events occasioned by the pivotal movement of a single lever, it is to be understood that the sliding movement of the motor alone can be carried out automatically while keeping the cartridge holder stationary.

FIGS. 8 to 10 show a modification of the type wheel and the connecting arm for connecting the shaft of the motor to the type wheel. In FIG. 8, a type wheel cartridge 101 of the box shape supports therein a petal-like type wheel 102. As shown in FIG. 9, the petal-like type wheel 102 includes a center disk 105 having a number of fingers 104 supporting type 103 at one end thereof and connected at the other end thereof to the disk 105 to extend radially therefrom. A hub 106 is attached to the center disk 105.

The cartridge 101 is formed therein with an opening 107 to allow selected one of the types 103 of the type wheel 102 to appear therein in a position in which the type is struck by the printing hammer as described by referring to the preceding embodiment. The cartridge 101 is formed with an aperture 101*a* for the hub 106 of the type wheel 102 to be loosely received therein when the type wheel 102 is inserted in the cartridge 101.

The hub 106 is formed with an opening for receiving a shaft 108 of the type selection motor therein. The shaft 108 has a tapering forward end portion 109 to permit the shaft 108 to be smoothly received in the opening in the hub 106 even if the type wheel 102 is somewhat displaced vertically in the cartridge 101. The shaft 108 and the opening in the hub 106 are constructed such that the minimum essential portion of the shaft 108 is fitted in the opening in the hub 106 without play, to reduce resistance to coupling when the shaft 108 is fully inserted in the opening in the hub 106. The shaft 108 has secured thereto as by a pin 111 a connecting arm unit 110 formed, as shown in FIG. 10, with a connecting arm 112 and a plurality of holding arms 113 (three in number as shown).

The center disk 105 of the type wheel 102 is formed with an engaging opening 114 for receiving therein the connecting arm 112 of the connecting arm unit 110 when the shaft 108 is fully inserted in the opening in the hub 106 of the type wheel 102. Rotation of the shaft 108 is transmitted to the type wheel 102 through the connecting arm 114 to positively rotate the type wheel 102 without any slip.

The center disk 105 of the type wheel 102 is formed with a plurality of holding openings 120 arranged in the outer marginal position of the disk 105 on the circumference of an imaginary circle and disposed equidistantly from one another in such a manner that the holding openings 120 index with the holding arms 113 of the connecting arm unit 110 respectively when the shaft 108 is inserted in the opening in the hub 106. The holding arms 113 are each bifurcated at the forward end portion into two parts, one part being formed as a stopper 115 abutting against one side of the center disk 105 of the type wheel 102 when the shaft 108 is fully inserted in the opening in the hub 106 of the center disk 105 to correctly position the connecting arm unit 110 and the type wheel 102 relative to each other and to hold the type wheel 102 in the correct posture and the other part being formed as a dislodging preventing member 116 inserted in one of the holding openings 120 to perform the function of preventing dislodging of the type wheel 102 from the connecting arm unit 110 secured to the shaft 108. The invention is not limited to the bifurcated holding arms 113 and the stopper 115 and the dislodging preventing member 116 can be formed as separate entities.

The dislodging preventing member 116 is formed as a resilient member and has a projection 117 at its forward end which extends radially of the type wheel 102. When the dislodging preventing member 116 is inserted in the respective holding opening 120 the projection 117 catches against the edge of the respective holding opening 120; on one side of the center disk 105. When the dislodging preventing member 116 in this position is forced with a predetermined force to pass through the holding opening 120, the projection 117 is flexed by the resilience of the material to enable the dislodging preventing member 116 to pass through the holding opening 120. After the dislodging preventing member 116 has passed through the holding opening 120, the projection 117 is brought into engagement with the edge of the holding opening 120 on the other side of the center disk 105. By this arrangement, the type wheel 102 is prevented from being inadvertently dislodged from the shaft 108. The edge of the holding opening 120 on the other side of the center disk 105 may be inclined to facilitate engagement of the projection 117 therewith.

When the shaft 108 is uncoupled from the cartridge 101, each dislodging preventing member 116 is withdrawn from the repective holding opening 120 of the type wheel 102 and each holding arm 113 is released from the type wheel 102. In this condition, the type wheel 102 is maintained substantially in a vertical position within the cartridge 101 by projections 118 formed on the front wall of the cartridge 102 and projections 119 formed on the inner surface of the rear wall of the cartridge 102.

The type wheel 102 is held in the home position by the mechanism shown in FIG. 1, so that when the shaft 108 is inserted in the cartridge 101, the connecting arm 112 can be smoothly inserted in the engaging opening 114.

When the shaft of the type selection motor having the connecting arm unit secured thereto as shown in FIG. 8 is connected to the type wheel cartridge, the type wheel is automatically coupled to the shaft of the type selection motor in such a manner that the type wheel can rotate freely without any interference by the cartridge. Thus the type wheel can be held in position without contacting the cartridge when the type wheel is rotated by the type selection motor or when the selected type is impacted by the printing hammer to perform a printing on the sheet. Moreover, the type wheel can be maintained in a vertical plane with respect to the axis of the type selection motor in a stable condition at all times. The type wheel supported in the cartridge can be rotated smoothly and impacting of the types can be carried out satisfactorily without the accident of the breaking of the type fingers, for example, taking place during a printing operation.

The provision of the tapering portion at the forward end portion of the motor shaft enables the connecting arm and the holding arms of the connecting arm unit to be smoothly brought into engagement with the type wheel and permits the motor shaft to be smoothly inserted in the opening in the hub of the type wheel. The motor shaft is snugly fitted in the opening in the hub of the type wheel without play, to ensure that the center of rotation of the type wheel does not wobble.

In this embodiment, the type wheel can be held in a vertical plane with respect to the shaft of the type selection motor by means of the connecting arm unit including three holding arms, and in addition the type wheel can be correctly positioned thereby. The holding arms of the connecting arm unit perform the function of preventing dislodging of the type wheel from its position in which it is coupled to the shaft of the type selection motor, so that the type wheel can be held positively in the stable condition.

As described hereinabove, the type wheel can be positively supported by the shaft of the type selection motor by a simple holding mechanism. Although the connecting arm unit has been described as having three holding arms, the invention is not limited to this specific number of the holding arm.

FIGS. 11 and 12 show another modification of the type wheel cartridge provided with means for holding the type wheel in the home position within the cartridge at all times after the type wheel is uncoupled from the shaft of the type selection motor. The type wheel can be held in the home position at all times so that loading and unloading of the cartridge and coupling of the type selection motor to the cartridge can be readily effected.

In FIGS. 11 and 12, a box-shaped cartridge 154 supports therein a petal-like type wheel 153 having a plurality of fingers 152 extending radially from the center of the type wheel 153 and each carrying a type 151 at its forward end.

The cartridge 154 is formed with an opening 155 for inserting the type wheel 153 therethrough into the cartridge 154, and the types 151 are struck by the printing hammer outside the opening 155 as shown in FIG. 1 during the printing operation. A printing window 156 is formed in the cartridge 154 and has dimensions sufficiently large for the types 151 to appear therein to permit the type struck by the printing to print a symbol on the sheet on the platen.

The type wheel 53 is formed with a hub 157 which is inserted in an opening 158 formed in the cartridge 154 and held loosely therein with play.

Formed in the cartridge 154 in a rear wall **154*b* opposite a front wall 154*a* in which the opening 158 is formed is an opening 163 which is large enough for rotatably receiving therein a connecting arm 162 secured as by a pin 161 to a shaft 160 of a type selection motor 159 when the cartridge 154 is connected to the type selection motor 159 as shown in FIG. 13**.

The cartridge 154 is formed at its front wall **154*a* with a guide recess 164 disposed in spaced juxtaposed relation to the platen for guiding the movement of the sheet, and vertical grooves 165 (FIG. 11) used for inserting the cartridge 154 in the cartridge holder. Also, a type wheel home position holding spring 166 formed of a resilient material is attached to the front wall 154*a* of the cartridge 154**.

The type wheel home position holding spring 166 is formed, as shown in FIG. 14, with a plurality of opening 167 for permitting rivets 168 to be inserted therethrough. The rivets 168 are peened over after penetrating the front wall **154*a* of the cartridge 154, to secure the spring 166 to the cartridge 154. The type wheel home position holding spring 166 has a free end portion formed therein with a holding claw 169 by bending the end portion in the form of a letter U. The invention is not limited to the shape and position of the holding claw 169 shown in the drawings, and they can be selected as desired. The invention is not also limited to the manner in which the type wheel home position holding spring 166 is secured to the front wall 154*a* of the cartridge 154** as shown in the drawings.

The type wheel home position holding spring 166 is formed therein with a projection 170 adapted to extend into the opening 158 formed in the front wall **154*a* of the cartridge 154. When the type wheel 153 is not coupled to the shaft 160 of the type selection motor 159, the projection 170 extends into a center opening 171 formed in the type wheel 153**.

The cartridge 154 is formed in its front wall **154*a* with an opening 172 for receiving the holding claw 169 of the home position holding spring 166. When the type wheel 153 is not coupled to the shaft 160 of the type selection motor 159, the holding claw 169 extends further inwardly from the opening 172 into a connecting opening 173 formed in the type wheel 153 as shown in FIG. 12. Thus the type wheel 153 is held in the home position within the cartridge 154 at all times by the type wheel home position holding spring 166**.

When the shaft 160 of the type selection motor 159 is coupled to the type wheel 153 within the cartridge 154, the type wheel 153 must be in the home position within the cartridge 154 and the connecting arm 162 must also be in the home position ready to the inserted in this connecting opening 173. That is, when the shaft 160 is inserted in the center opening 171 of the type wheel 153, a connecting claw 174 of the connecting arm 162 is smoothly inserted in the connecting opening 173 of the type wheel 153, so that rotation of the shaft 160 can be positively transmitted to the type wheel 153 through the connecting arm 162.

The shaft 160 of the type selection motor 159 has a tapering forward end portion **160*a* to enable the shaft 160 to be readily and positively inserted in the center opening 171** even if the position of the type wheel is radially displaced.

The shaft 160 inserted into the center opening 171 pushes at its forward end the projection 170 of the type wheel home position holding spring 166 out of the center opening 171. This causes the spring 166 to be flexed and bring the holding claw 169 out of engagement in the connecting opening 173 of the type wheel 153. The type wheel home position holding spring 166 is constructed such that the movement of the holding claw 169 into and out of the connecting opening 173 is timed to the movment of the connecting claw 174 of the connecting arm 162 into and out of the connecting opening 173. As shown, insertion of the shaft 160 in the center opening 171 pushes the projection 170 of the spring 166 out of the center opening 171, and withdrawal of the shaft 160 from the center opening 171 allows the projection 170 of the spring 166 to extend into the center opening 171 by the resilience of the spring 166. At this time, the length of the holding claw 169 projecting into the connecting opening 173 varies depending on the amount of flexing of the spring 166. Meanwhile the length of the connecting claw 174 projecting into the connecting opening 173 varies in a manner to compensate for a change in the length of the holding claw 169 projecting into the connecting opening 173. By this arrangement, at least one of the connecting claw 174 and the holding claw 169 is engaged in the connecting opening 173 of the type wheel 153, thereby enabling the type wheel 153 to be held in the home position irrespective of whether or not the type wheel 153 is coupled to the type selection motor 159.

Thus the type wheel can be held in the home position at all times and the need to move the type wheel is eliminated when the cartridge is coupled to the type selection motor.

What is claimed is:

1. In a printer comprising a platen, a type wheel including a plurality of fingers arranged radially each carrying a type at the forward end, a printing hammer unit, an ink ribbon, a type selection motor and a carriage supporting the type wheel, hammer unit, ribbon and motor, movable along the platen, the printer being operable to print symbols on a sheet on the platen, wherein the improvement comprises:

a type wheel cartridge rotatably supporting the type wheel;

a cartridge holder for removably holding said type wheel cartridge mounted to the carriage for movement perpendicularly to the movement of the carriage between an operative and a standby position;

the type selection motor having a shaft and mounted to the carriage for movement parallel to the movement of said carriage holder between an operative and a standby position and axially of the type wheel; and drive means for moving said cartridge holder and the type selection motor between the respective operative and standby positions, with a moving distance of the type wheel selection motor being greater than a moving distance of said cartridge holder so that the type wheel receives in the type wheel cartridge the type selection motor shaft when said cartridge holder and the type selection motor are both in their respective operative positions.

2. A printer as claimed in claim 1, wherein said drive means comprises a lever supported at a pivot for reciprocatory pivotal movement and having said cartridge holder and the type selection motor connected thereto through connecting means.

3. A printer as claimed in claim 2, wherein the distance covered by the movement of the connecting means connecting said cartridge holder to said lever varies from the distance covered by the movement of the connecting means connecting the type selection motor to said lever as said lever moves in reciprocatory pivotal movement.

4. A printer as claimed in claim 2 including means connected to said lever for moving said lever in reciprocatory pivotal movement.

5. A printer as claimed in claim 4, wherein said means for moving said lever comprises a nut mounted on said lever, a threaded shaft threadably connected to said nut, and a motor for reversively rotating said threaded shaft.

6. A printer as claimed in claim 4, wherein said means for moving said lever comprises a cylinder actuatable by a fluid to move said lever.

7. A printer as claimed in claim 2, wherein said pivot at which said lever is pivotally supported is spaced apart from said connecting means connecting said cartridge holder to said lever by one distance and spaced apart from said connecting means connecting the type selection motor to said lever by another distance.

8. A printer as claimed in claim 1, wherein the type wheel includes a center disc portion to which the fingers are connected, said center disc portion having a central opening into which the motor shaft is inserted in the operative positions of the type selection motor and said cartridge holder, said center disc including a plurality of engaging openings spaced from said central opening, a connecting arm unit connected to the motor shaft having a plurality of arms, said arms being inserted into said engaging openings, at least some of said arms comprising holding arms having a holding projection for biasing said center disc toward the type selection motor, said holding arms including a stopper abutting against said centering disc, and a type wheel home position holding member connected to said cartridge for holding the type wheel in a home position when said cartridge holder and type selection motor are in their respective standby positions and for releasing the type wheel when said cartridge holder and type selection motor are in their respective operative positions.

9. A printer as claimed in claim 8 wherein said type wheel home position holding member comprises a type wheel home position holding spring secured to said type wheel cartridge, said type wheel home position holding spring being formed with a holding claw operative to be resiliently received in one of said engagement openings in the type wheel through an opening formed in said type wheel cartridge.

10. A printer as claimed in claim 9 wherein said type wheel home position holding spring is positioned on said cartridge to be moved so as to disengage said holding claw from said engagement opening by movement of the motor shaft against said type wheel home position holding spring when said cartridge holder and type selection motor are moved into their respective operative positions.

11. A printer as claimed in claim 8, wherein said holding arm is formed as a resilient member and said holding projection is formed as a projection protruding radially of the type wheel.

12. A printer according to claim 1 including means for mounting said type wheel on the shaft of said type selection motor comprising engaging openings provided in a center disk of said type wheel and a connecting arm unit mounted on said shaft of said type selection motor being formed with a plurality of arms, said arms being inserted in the engaging openings;

said arms comprising with at least one connecting member and a plurality of holding arms, said holding arms respectively having a stopper abutting against said center disk and a member biasing said type wheel toward said stopper for holding the type wheel upright to the shaft when the shaft of said type selection motor is inserted in said type wheel.

13. A printer as claimed in claim 12 comprising a type wheel home position holding spring secured to said type wheel cartridge, said type wheel home position holding spring being formed with a holding claw operative to be resiliently received in an engaging opening formed in said type wheel through an opening formed in said type wheel cartridge.

14. A printer as claimed in claim 13, wherein said type wheel home position holding spring is further formed with a projection operative to be received in an opening formed in a hub of said type wheel, said type wheel home position holding spring being constructed such that said holding claw is withdrawn from said engaging opening of said type wheel in an amount corresponding to the amount of movement of said projection out of the opening formed in the hub of said type wheel caused by the shaft of the type selection motor as the latter in coupled to the type wheel.

15. A printer as claimed in claim 12, wherein said biasing member is formed as a resilient member and has a projection extending radially of the type wheel at its forward end.

16. A printer as claimed in claim 1, wherein the type wheel includes a center disc portion to which the fingers are connected, said center disc portion having a central opening into which the motor shaft is inserted in the operative position of the type selection motor and said cartridge holder, said center disc including a plurality of engaging openings spaced from said central opening, a connecting arm unit connected to the motor shaft having a plurality of arms, said arms being inserted into said engaging openings, at least some of said arms comprising holding arms having a holding projection for biasing said center disc toward the type selection motor, said holding arms including a stopper abutting against said center disc.

17. A printer as claimed in claim 16, wherein said holding arm is formed as a resilient member and said holding projection is formed as a projection protruding radially of the type wheel.

18. A printer as claimed in claim 1, wherein said type wheel carriage has a front plate facing the platen and formed with a guide recess disposed in spaced juxtaposed relation to the platen for guiding a sheet and said guide recess is formed with a window for permitting a type to extend therethrough a print a symbol on a sheet.

19. A printer as claimed in claim 1, wherein said type wheel cartridge has side plates formed with ribbon guide means.

20. A printer as claimed in claim 19, wherein said ribbon guide means are formed as a groove formed in each side plate at upper ends thereof.

21. A printer as claimed in claim 1, wherein said cartridge holder is provided with a cartridge detection element for ascertaining the loading of the type wheel cartridge in a predetermined position and for giving a driving signal to said drive means.

22. A printer as claimed in claim 21, wherein said cartridge detection element comprises a microswitch.

* * * * *